US007727001B2

(12) United States Patent
Percherke et al.

(10) Patent No.: US 7,727,001 B2
(45) Date of Patent: Jun. 1, 2010

(54) ELECTRICAL CONNECTOR ASSEMBLY

(75) Inventors: Michael Percherke, Enola, PA (US); Richard Wayne Grzybowski, Palmyra, PA (US); Michael Allen Blanchfield, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/873,992

(22) Filed: Oct. 17, 2007

(65) Prior Publication Data

US 2009/0104802 A1 Apr. 23, 2009

(51) Int. Cl.
*H01R 13/64* (2006.01)

(52) U.S. Cl. ..... 439/378

(58) Field of Classification Search ..... 439/374, 439/378, 153, 752, 78, 68
See application file for complete search history.

(56) References Cited

U.S. PATENT DOCUMENTS 4,647,130 A 3/1987 Blair et al.
4,761,144 A * 8/1988 Hunt et al. ..... 439/545
4,812,133 A * 3/1989 Fleak et al. ..... 439/248
5,547,385 A 8/1996 Spangler
6,659,796 B1 * 12/2003 Waddell et al. ..... 439/557
6,881,102 B2 4/2005 Correll et al.
7,059,919 B2 * 6/2006 Clark et al. ..... 439/825
7,137,848 B1 11/2006 Trout et al.

OTHER PUBLICATIONS

Tyco Electronics; "Multi-beam XL Connectors"; May 11, 2007; 15pgs.

* cited by examiner

*Primary Examiner*—Alexander Gilman

(57) ABSTRACT

A receptacle for an electrical connector assembly is provided and includes a housing having a contact retention portion for holding an electrical contact. The contact retention portion includes a connector face for engaging a plug assembly and a side proximate to the connector face. The receptacle also includes a guide post that is located adjacent to the side and extends along the side toward the connector face. The guide post includes a base and a tip. The guide post also has a curved contour and a planar side that extend from the base to the tip.

20 Claims, 9 Drawing Sheets

ELECTRICAL CONNECTOR ASSEMBLY

BACKGROUND OF THE INVENTION

The invention relates generally to electrical connectors, and more particularly to a connector assembly with improved guidance and mounting features.

Electrical connector assemblies are used to connect electrical components within an electronic device or system and transmit electrical power or signals therebetween. Frequently, the electrical connector assemblies are mounted to a circuit board or another part of the device. Because the amount of available surface area on the circuit board or within the device is limited, the size of the connector assemblies should be minimized.

In one conventional system, the system is formed by connecting a receptacle to a plug assembly. The receptacle includes a rectangular housing that is shaped to hold a series of electrical contacts along a length of the housing. The electrical contacts are stacked or positioned collinear with respect to each other. A pair of guide posts are connected to opposite ends of the rectangular housing with the electrical contacts arranged therebetween. The guide posts have a substantially cylinder-like shape with a rounded tip. The plug assembly includes a cavity that is shaped to have circular openings for receiving the cylindrical guide posts. When the receptacle and the plug assembly are connected, the rounded tips of the guide posts contact an edge of the openings, which forces the receptacle and plug assembly into alignment. The guide post is then received by the corresponding opening. In this conventional configuration, cylindrical guide posts are spaced laterally apart from a central portion of the receptacle by a clearance area that is wide enough to receive a portion of the plug assembly surrounding the opening. However, because the guide posts are located along both sides of the receptacle the overall width of the receptacle (and thus the circuit board surface area) is dependent upon the size and spacing of the guide posts.

In another conventional system, similar to the one discussed above, supports are formed with the housing of the receptacle with each support having a hole extending into the support. The hole may hold a threaded fastener such as a screw for mounting to a circuit board. Alternatively, the receptacle may be formed with a latch member for gripping the circuit board. Heretofore, two different types of receptacle configurations were manufactured, one for use with threaded fasteners and one for use with a latch member. Also, neither type of receptacle offered a redundant mounting mechanism.

Thus, there remains a need for an electrical connector assembly that reduces the amount of surface area used and for connector assemblies that provide multiple options for mounting.

BRIEF DESCRIPTION OF THE INVENTION

In one embodiment, a receptacle for an electrical connector assembly is provided and includes a housing having a contact retention portion for holding an electrical contact. The contact retention portion includes a connector face for engaging a plug assembly and a side proximate to the connector face. The receptacle also includes a guide post that is located adjacent to the side and extends along the side toward the connector face. The guide post includes a base and a tip. The guide post also has a curved contour and a planar side that extend from the base to the tip.

Optionally, the planar side is positioned proximate to the side of the housing. Moreover, the receptacle may also have a mounting structure that extends outward from and along the side of the housing. The base of the guide post may extend from the mounting structure.

In another embodiment, a receptacle for mounting to an electrical component includes a housing that has a contact retention portion for holding an electrical contact. The contact retention portion includes a connector face for engaging a plug assembly and a side that is proximate to the connector face. The receptacle also includes a mounting structure that extends outward from and along the side of the retention portion. The mounting structure includes a fastener passage and a latch cavity that extend into the mounting structure in substantially parallel directions. The fastener passage is positioned adjacent to the latch cavity and configured to receive a fastener for mounting to a surface of the electrical component. The latch cavity is configured to receive a latch member for mounting to the surface.

In yet another embodiment, a receptacle for mounting to an electrical component is provided. The receptacle includes a contact retention portion for holding an electrical contact. The receptacle includes a connector face for engaging a plug assembly and a side that is proximate to the connector face. The receptacle also includes a mounting structure that extends outward from and along the side. The mounting structure includes a fastener passage and a latch cavity that extend into the mounting structure in substantially parallel directions. The fastener passage is configured to receive a fastener for mounting to the electrical component and the latch cavity is configured to receive a latch member for mounting to the electrical component. Also, the receptacle includes a guide post that extends from the mounting structure. The guide post includes a base and a tip. The guide post also has a curved contour and a planar side that extend from the base to the tip.

DETAILED DESCRIPTION OF THE INVENTION

Figure 1:
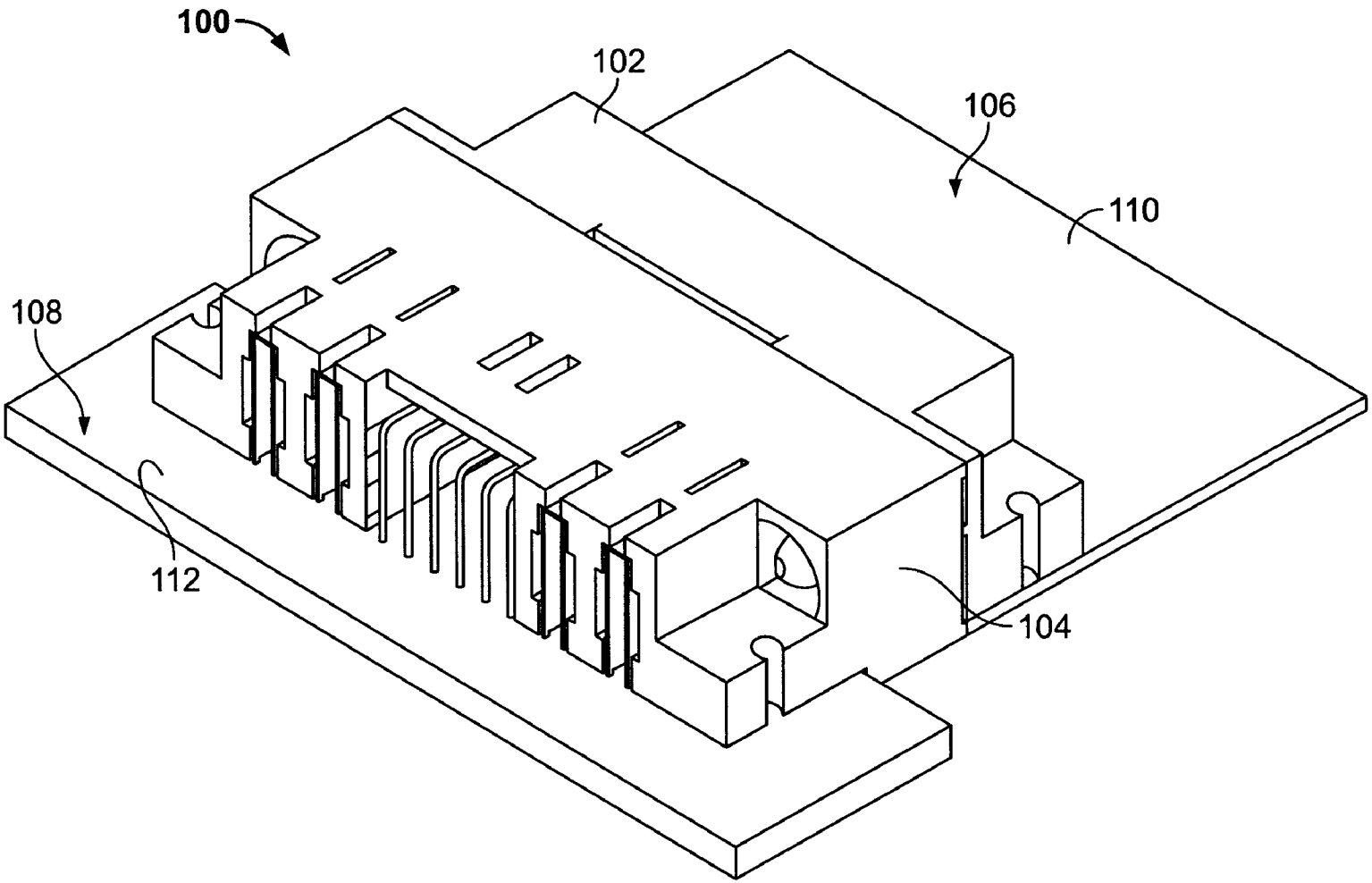
FIG. 1 is a perspective view of an electrical connector assembly formed in accordance with an exemplary embodiment.

FIG. 1 is a perspective view of an electrical connector assembly 100 formed in accordance with an exemplary embodiment. The electrical connector assembly 100 includes a plug assembly 104 and a receptacle 102 that are engaged with one another. The electrical connector assembly 100 may connect two electrical components 106 and 108. In FIG. 1, the receptacle 102 is mounted to the electrical component 106 and the plug assembly 104 is mounted to the electrical component 108. The connector assembly 100 allows transmission of power and/or signals through a plurality of contacts (described below) between the electrical components 106 and 108.

As shown in FIG. 1, the electrical component 106 is represented by a circuit board 110 and the electrical component 108 is represented by another circuit board 112. Circuit boards 110 and 112 may be made of a glass epoxy and have a plurality of contact holes (not shown) therethrough. Although FIG. 1 shows the connector assembly 100 directly connected to the circuit boards 110 and 112, the connector assembly 100 can also be used for connecting electrical components that are located remotely from each other. For example, the plug assembly 104 or the receptacle 102 may connect to the corresponding electrical component using a cable.

Furthermore, the connector assembly 100 may be used to join two cables in which each cable connects to an electrical component that is located remotely from connector assembly 100.

Figure 2:
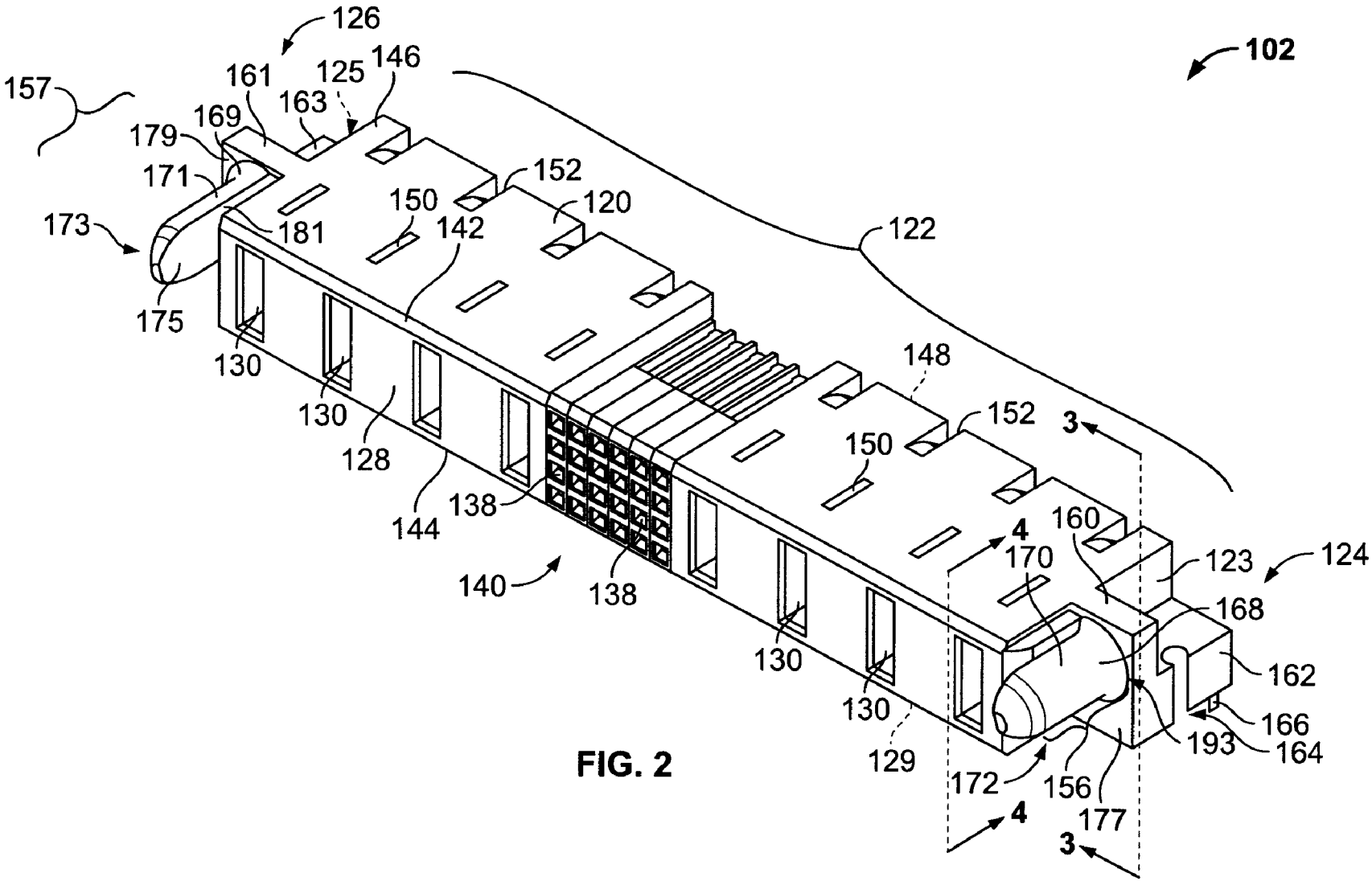
FIG. 2 is a perspective view of a receptacle used with the connector assembly shown in FIG. 1.

FIG. 2 is a perspective view of the receptacle 102 when the receptacle 102 is not engaged with the plug assembly 104 (FIG. 1). The receptacle 102 includes a housing 120 that includes a connector face 128, a mounting interface 129, a top 146, and a back 148. The housing 120 is made of an insulative material, such as a thermoplastic, and holds a plurality of electrical contacts (not shown). For example, the housing 120 may be made of a glass-filled high-temperature nylon. Furthermore, the housing 120 may be integrally formed or molded to include the components discussed below as part of a unitary structure. Alternatively, the housing 120 may be constructed from separate components which may or may not be made from the same material.

In FIG. 2, the housing 120 includes a contact retention portion 122 that extends between a pair of opposing sides 123 and 125. The contact retention portion 122 is configured to hold one or more electrical contacts (not shown). The connector face 128 of the retention portion 122 may have a pair of beveled edges 142 and 144 that facilitate engaging and directing the receptacle 102 into the plug assembly 104 (FIG. 1). The retention portion 122 is configured to hold the plurality of contacts that are oriented and positioned to engage corresponding contacts 226 or 224 (shown in FIG. 7) for transmitting power and/or signals. The connector face 128 includes a plurality of power recesses 130 having a rectangular shape and oriented in a substantially upright position. Each power recess 130 holds a power contact (not shown) that receives a corresponding power contact 226 from the plug assembly 104 for transmitting electrical power therebetween. Furthermore, the connector face 128 includes a plurality of sockets 138 each of which holds a signal contact (not shown) that receives a corresponding signal contact 224 in the plug assembly 104. In one embodiment, the sockets 138 form a socket array 140 where, for example, the sockets 138 are in a row-and-column arrangement.

The top 146 has a generally flat, planar surface and includes a plurality of apertures 150. Each aperture 150 corresponds to a power recess 130. Furthermore, the top 146 is formed along with the back 148 to have a plurality of convection windows 152 for dissipating heat from the power contacts when the connector assembly 100 (FIG. 1) is in use.

The retention portion 122 can have various spacings between the power recesses 130, which may be dependent upon the voltage level transmitted through the power recess 130. Generally, when the power contacts transmit higher voltages the spacing is increased between the power recesses 130. Moreover, the length of the retention portion 122 may expand to accommodate more or fewer power recesses 130. Likewise, the array 140 of sockets 138 can be configured to have more or fewer sockets 138 to accommodate the application's needs.

Also shown in FIG. 2, a pair of mounting structures 124 and 126 are positioned adjacent to or extend outward from and along the sides 123 and 125, respectively. The mounting structures 124 and 126 each include a platform 160, 161, a step 162, 163, and guide post 156, 157, respectively. With respect to the mounting structure 124, the platform 160 and the step 162 may be substantially perpendicular to each other. The platform 160 may extend perpendicular to the side 123 with a surface 177 that is parallel to the surface of the connector face 128. The step 162 includes a fastener passage 164 and a latch cavity 182 (shown in FIG. 5) that extends at least partially into the step 162. A latch member 166 projects from the cavity 182 and mounting interface 129. Also shown, the guide post 156 projects from the platform 160 in a direction substantially perpendicular to the surface 177 of the platform 160. More specifically, the guide post 156 extends beyond the connector face 128 in a direction that is substantially perpendicular to a plane formed by the connector face 128. The guide post 156 includes a base 168 that forms into a body 170 and a tip 172. The guide post 156 also includes a planar side 174 (shown in FIG. 4) that is shared by the body 170 and tip 172. The planar side 174 projects beyond the connector face 128 in a direction that is perpendicular to the plane formed by the connector face 128. In one embodiment, the planar side 174 abuts side 123 and is immediately adjacent to the connector face 128 such that the planar side 174 and the connector face 128 meet at an edge (not shown). Also, the body 170 may have a protuberance 193.

Similarly, with respect to the mounting structure 126, the platform 161 may be substantially perpendicular to the step 163. The platform 161 may extend outwardly and perpendicular to the side 125 with a surface 179 that is parallel to the connector face 128. The step 163 has a fastener passage 165 and a latch cavity 183 (shown in FIG. 5) that is similar to the fastener passage 164 and latch cavity 182. Also shown, the guide post 157 projects from the platform 161 in a direction substantially perpendicular to the surface 179 of the platform 161. More specifically, the guide post 157 extends beyond the connector face 128 in a direction that is substantially perpendicular to a plane formed by the connector face 128. The guide post 157 includes a base 169 that forms into a body 171 and a tip 173. The planar side 175 projects beyond the connector face 128 in a direction that is perpendicular to the plane formed by the connector face 128. In one embodiment, the planar side 175 abuts side 125 and is immediately adjacent the connector face 128 such that the planar side 175 and the connector face 128 meet at an edge 181. Although not shown, the body 171 may have a protuberance similar to the protuberance 193.

Figure 4:
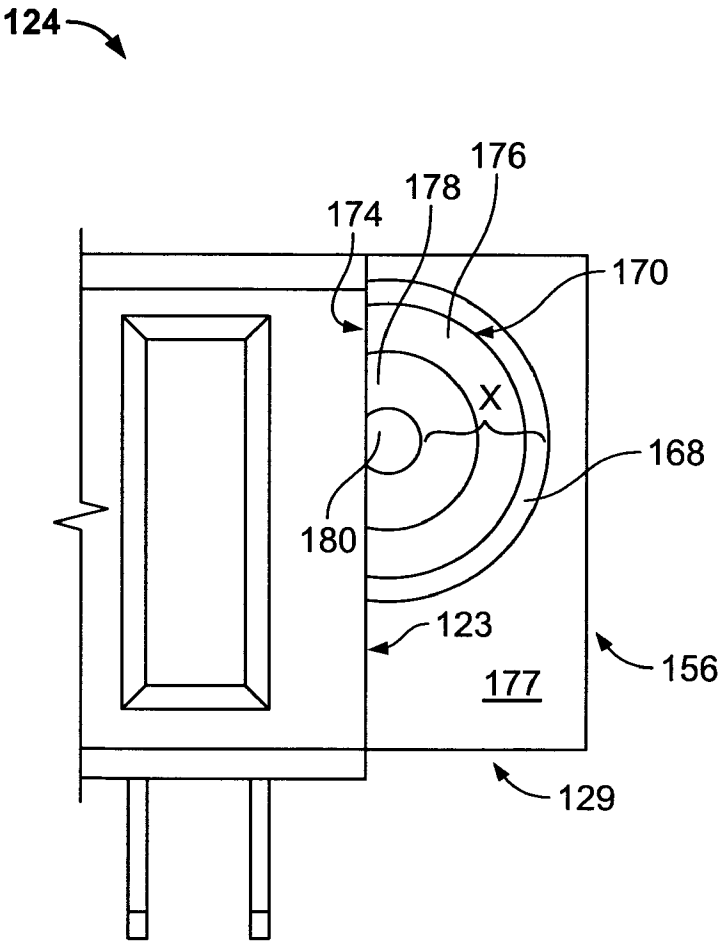
FIG. 4 is a front view of the guide post used with the receptacle shown in FIG. 2.
Figure 3:
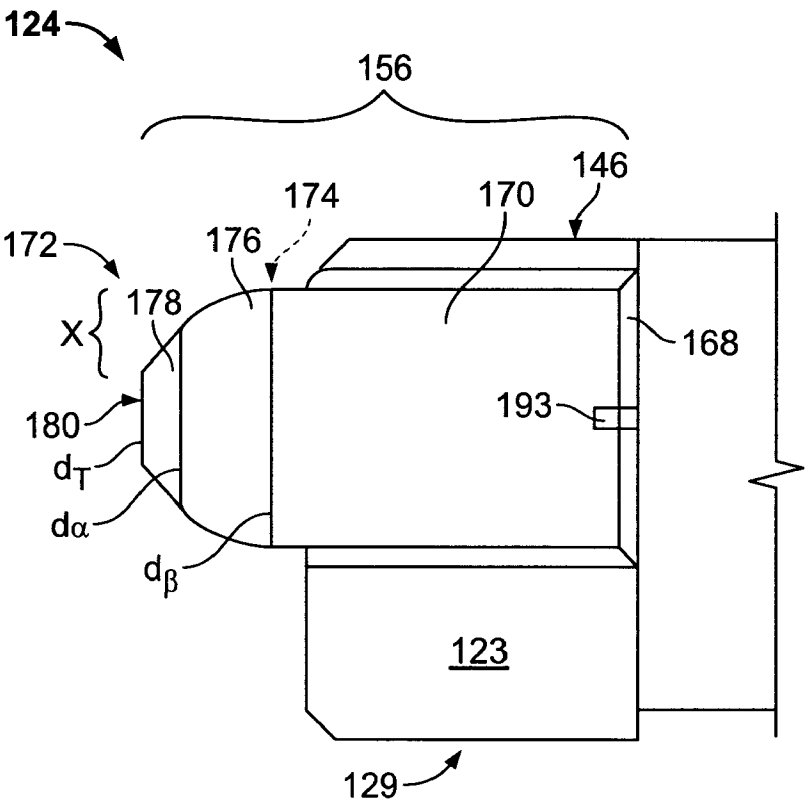
FIG. 3 is a side-view of the guide post used with the receptacle shown in FIG. 2.

FIG. 3 shows a side view of the mounting structure 124 taken along the line 3-3 shown in FIG. 2. FIG. 4 is a front planar view of the mounting structure taken along line 4-4. Although the following discussion relates to the mounting structure 124, the description may similarly be applied to the corresponding parts of the mounting structure 126. As shown in FIGS. 3 and 4, the guide post 156 may be positioned closer to the top 146 than to the mounting interface 129. The base 168 extends from the platform 160 and forms the body 170. The body has a diameter $d_B$. The body 170, in turn, forms the tip 172 including a curved portion 176 and a linear portion 178. The tip 172 has a continuously decreasing diameter as the guide post 156 extends to a distal end away from platform 160. More specifically, as shown in FIG. 3, the curved portion 176 has a non-linear slope such that the diameter $d_B$ at the beginning of the curved portion 176 decreases in a non-linear manner. The linear portion 178 has a diameter $d_L$ that decreases in a linear manner. In one embodiment, the tip 172 includes a flat top 180 having a diameter $d_T$.

In one embodiment, the tip 172 and at least a portion of the body 170 share the planar side 174. More specifically, a width of the planar side 174 is substantially equal to the diameter of the guide post 156 as the post 156 extends outward to the distal end. As such, the base 168, the body 170, and the tip 172 have a curved contour. More specifically, post 156 may have a crescent or semi-circle shape. With the guide post 156 having a substantially crescent or semi-circle shape, the guide post 156 is substantially reduced in size with respect to a guide post having a complete circle or cylinder shape. In one embodiment, a cross-sectional area of the guide post 156 is slightly greater than a half-circle. In alternative embodiments, the guide post 156 may be constructed to have a variety of geometric shapes provided that the tip 172 includes at least one portion with decreasing cross-sectional areas. For example, portions 176 and 178 may form a half-pyramid that decreases in width to a point forming a triangular shaped top or a half-pyramid that decreases to a flat, square-like top.

At the beginning of the tip 172, the guide post 156 has a diameter $d_B$. As the guide post 156 extends outward toward the distal end, the diameter of the tip 172 decreases to a diameter of $d_T$. As will be discussed below, the difference between the diameters $d_B$ and $d_T$ is a distance X, which represents the distance that the receptacle 102 may be misaligned with respect to the plug assembly 104.

Figure 5:
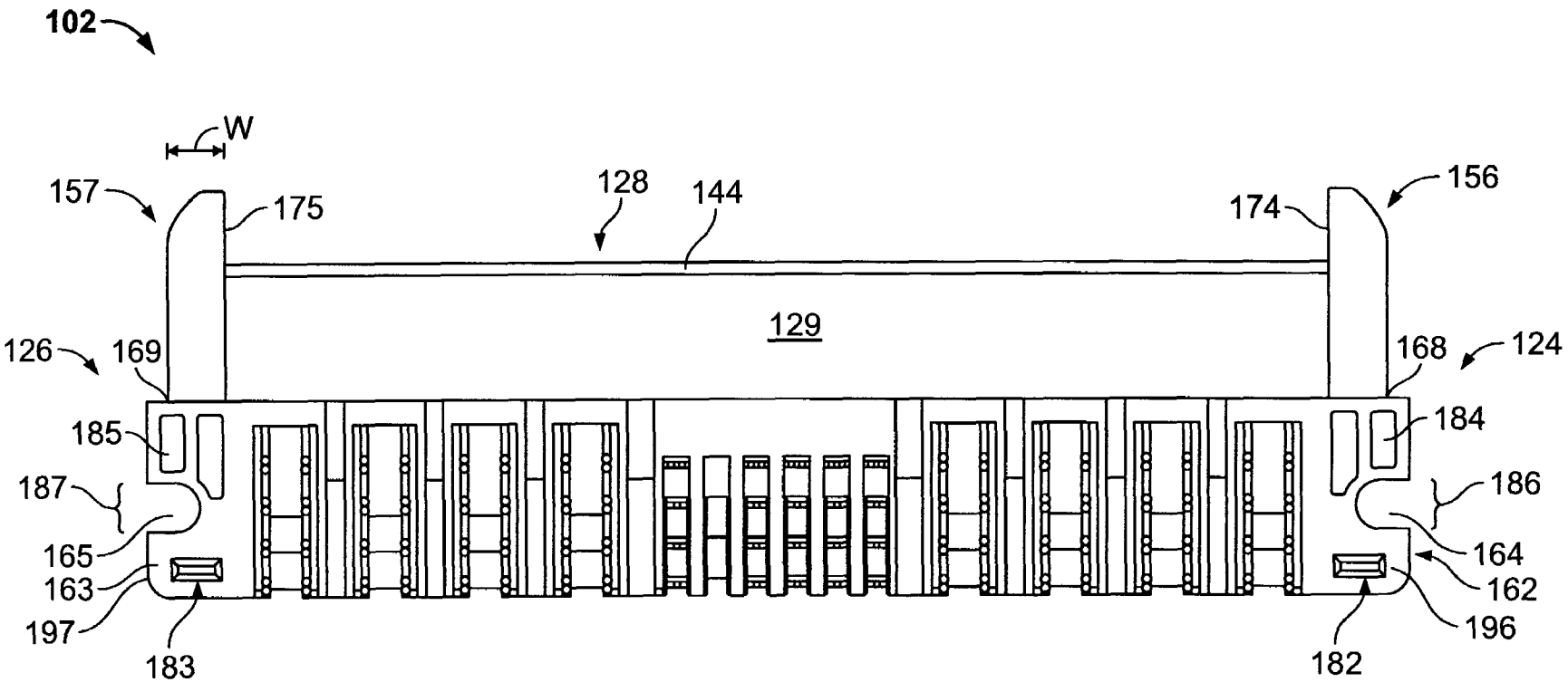
FIG. 5 is a bottom view of the receptacle shown in FIG. 2.

FIG. 5 is a bottom planar view of the receptacle 102 showing the mounting interface 129. As can be seen, the connector face 128 and the beveled edge 144 extend between the two opposing guide posts 156 and 157, which extend in a substantially perpendicular direction with respect to the connector face 128. More specifically, the connector face 128 extends between planar sides 174, 175. As such, the planar side 175 of post 157 may directly oppose the planar side 174 of post 156. Also shown in FIG. 5, with respect to mounting structure 124, an underside of the step 162 has a plurality of openings including an opening of fastener passage 164, an opening for latch cavity 182, and two openings for two material cavities 184. In one embodiment, the fastener passage 164 has an exposed side opening 186 that extends down a side 196 of the step 162. By having the exposed side opening 186, the mounting structure 124 may be reduced in size with respect to other structures used by conventional receptacles. The latch cavity 182 is configured to hold or grip the latch member 166 (FIG. 2). The latch member 166 may be, for example, a boardlock or hold down clip.

With respect to mounting structure 126 shown in FIG. 5, an underside of the step 163 has a plurality of openings including an opening of fastener passage 165, an opening for latch cavity 183, and two openings for two material cavities 185. In one embodiment, the fastener passage 165 has an exposed side opening 187 that extends down a side 197 of the step 163. The latch cavity 183 is configured to hold or grip the latch member (not shown). Likewise, this latch member may be, for example, a boardlock or hold down clip.

Figure 6:
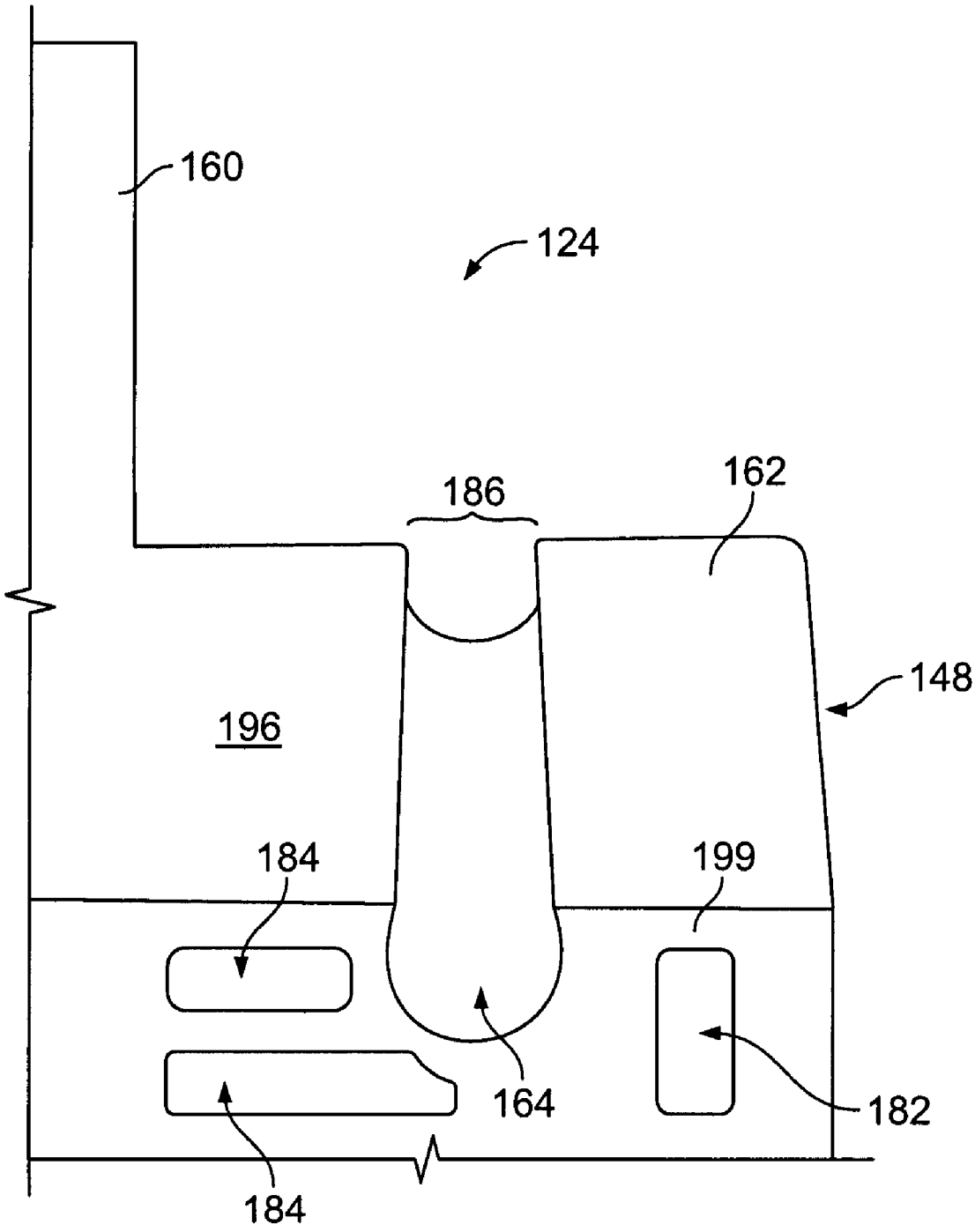
FIG. 6 is a side perspective view of one support used with the receptacle shown in FIG. 2.

FIG. 6 is a side perspective view of the mounting structure 124 illustrating the positions of the fastener passage 164, the latch cavity 182, and the material cavities 184. Although not shown, the following description may be similarly applied to the mounting structure 126. As can be seen in FIG. 6, the passage 164 and the cavities 182, 184 are positioned to minimize the width of the step 162. More specifically, the latch cavity 182 is positioned between the back 148 and the fastener passage 164 and a distance away from side 196. This distance may be minimized provided that a wall 199 formed between the cavity 182 and the side 196 has a thickness that is sufficient to support or hold a latch member (not shown in FIG. 6). Although FIG. 6 shows a length of the cavity 182 as perpendicular to the side 196, another embodiment may position the length of the cavity 182 parallel to the side 196. Furthermore, the cavity 182 may be positioned on the other side of the fastener passage 164 between the passage 164 and the connector face 128 (FIG. 2).

As such, the latch cavities 182, 183 and the fastener passages 164, 165 provide a mountable receptacle 102 with two mounting options while minimizing the surface area needed to provide the two options. As discussed above, the width of posts 156 and 157 are substantially reduced with respect to conventional receptacles. Thus, the mounting structures 124 and 126 use a reduced amount of space with respect to the conventional mounting structures while still providing alignment correction and two different options for mounting the receptacle 102 to a component.

Although the mounting structures 124 and 126 are described relative to the receptacle 102, the mounting structures 124 or 126 may similarly be applied or manufactured with the plug assembly 104 or any other electrical connector component that may be mounted to, for example, a circuit board.

Figure 7:
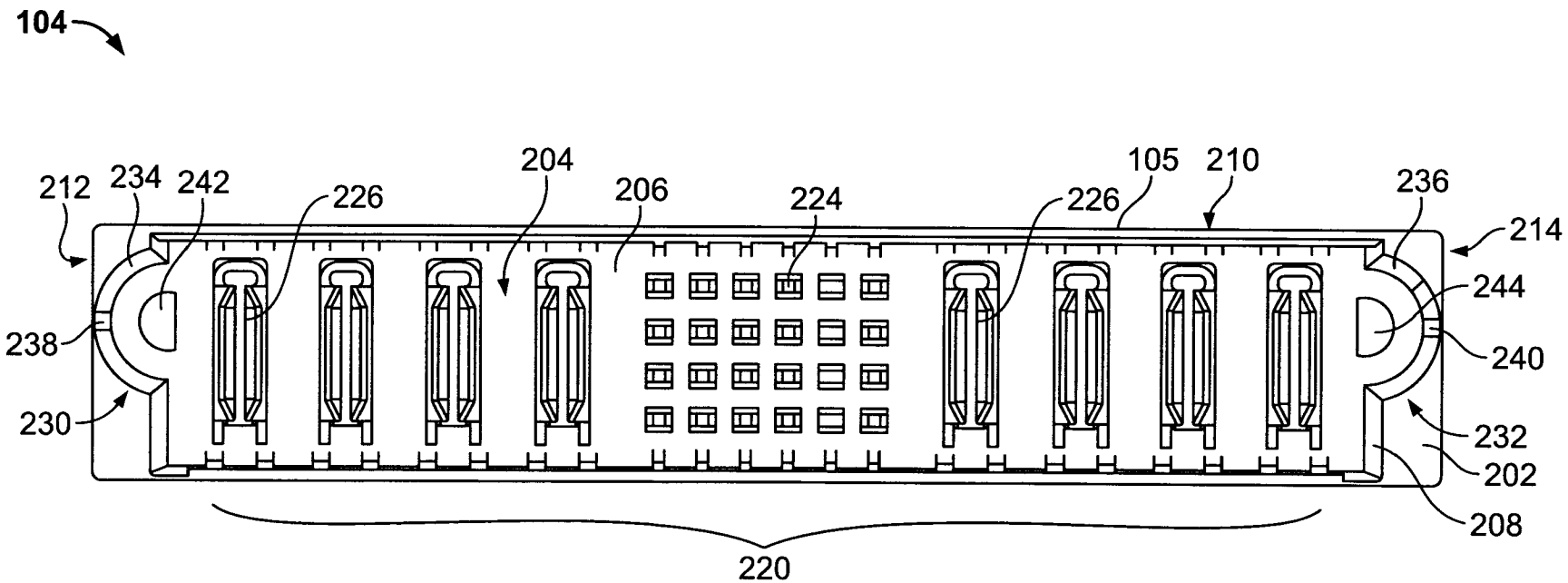
FIG. 7 is a front planar view of the plug assembly shown in FIG. 1.

FIG. 7 is a front planar view of the plug assembly 104 used in the electrical connector assembly shown in FIG. 1. The plug assembly 104 includes a plug housing 105 that is substantially rectangular and has a top surface 210, sides 212 and 214, and a connector face 202. The connector face 202 includes a contact cavity 204, which is defined by a contact wall 206 and a cavity sidewall 208. The contact wall 206 defines a rear of the cavity 204 and the cavity sidewall 208 circumscribes the cavity 204. A plurality of conductive signal contacts 224 and/or a plurality of conductive power contacts 226 project from the contact wall 206. The conductive contacts 224 and 226 may be made of a high-conductivity copper alloy.

The plug assembly 104 has a contact retention portion 220 that is complementary to the arrangement of recesses 130 and/or sockets 138 in the retention portion 122 (FIG. 2). More specifically, the contact retention portion 220 includes the signal contacts 224, which are arranged to engage the contacts in the array 140 of sockets 138 in the receptacle 102, and a plurality of power contacts 226 that engage the contacts in the corresponding power recesses 130.

The cavity 204 includes a pair of opposing guide openings 230 and 232 that may be proximate to the sides 212 and 214, respectively. The guide openings 230 and 232 are shaped to receive guide posts 156 and 157 (FIG. 2), respectively, when the plug assembly 104 and the receptacle 102 are engaged. In each opening 230, 232, the cavity sidewall 208 extends outward from the contact wall 206 to a beveled edge 234, 236, respectively, that slopes outward toward the connector face 202. A notch 238, 240 may be cut into each beveled edge 234, 236, respectively. Moreover, the guide openings 230 and 232 may each have a rear aperture 242 and 244, respectively, that are cut into the contact wall 206. The rear apertures 242 and 244 are shaped such that a section of the tips 172 may move through rear apertures 242 and 244 when engaged.

Figure 8:
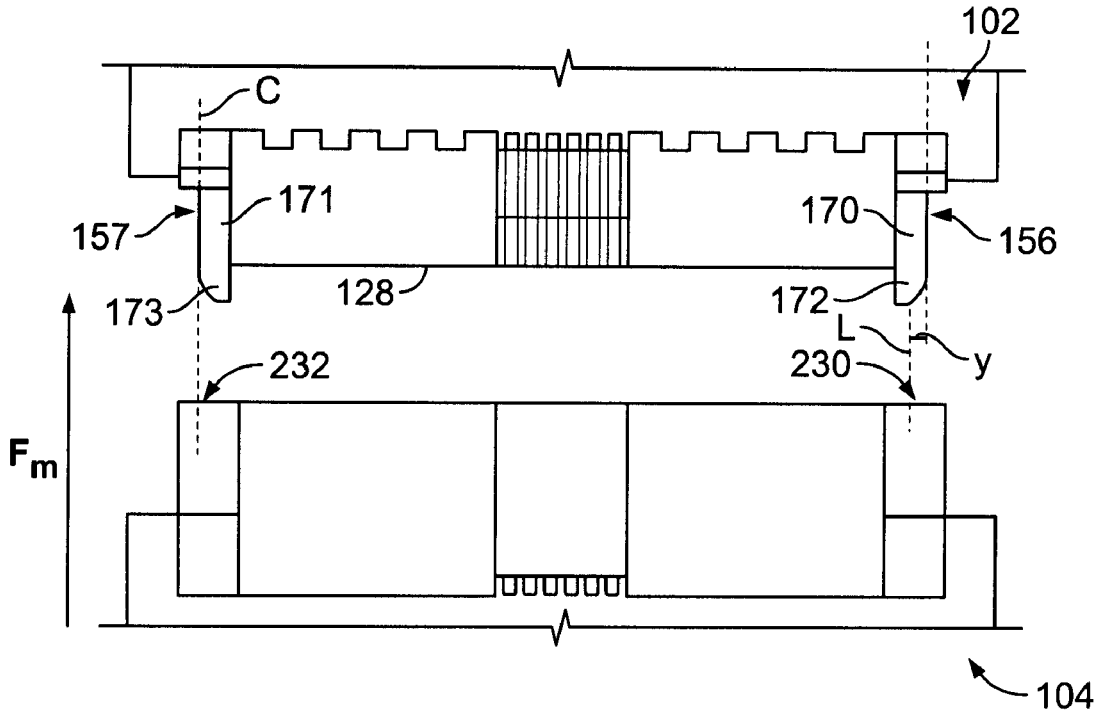
FIG. 8 is a top view as the plug assembly engages with the receptacle to form the connector assembly shown in FIG. 1.
Figure 9:
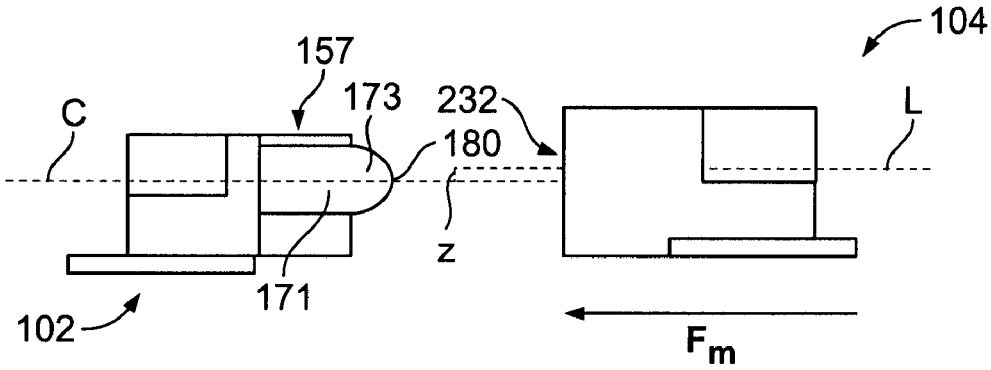
FIG. 9 is a side view of the plug assembly and the receptacle shown in FIG. 8.

FIGS. 8 and 9 illustrate a top planar view and a side view, respectively, of the electrical connector assembly 100 as the plug assembly 104 and the receptacle 102 are about to engage. During the engaging process, it may be difficult to precisely align guide posts 156 and 157 with guide openings 230 and 232, respectively. As shown, the guide posts 156 and 157 include centerlines C that are surface tangents of bodies 170 and 171, respectively, extending longitudinally along an apex of the surface of bodies 170 and 171 and also extending through a vertical center of the respective guide post. The guide opening 230 also has a line L that extends along a surface of the cavity sidewall 208 (FIG. 7). When the plug assembly 104 and the receptacle 102 are engaged, the centerline C becomes substantially coincident with line L. When the receptacle 102 and the plug assembly 104 are not laterally aligned, the guide post 156 and 157 must be laterally moved a distance y (FIG. 8) which is the lateral distance between lines C and L. Likewise, when the receptacle 102 and the plug assembly 104 are not vertically aligned, the guide post 156 and 157 must be vertically moved a distance z (FIG. 9) which is the vertical distance between lines C and L.

As shown in FIGS. 8 and 9, in order to form the connector assembly 100, the receptacle 102 and the plug assembly 104 are positioned in front of each such that the connector face 128 of the receptacle 102 opposes the contact wall 206 (206) of the plug assembly 104. A mating force $F_m$ is then applied to the plug assembly 104 so that the plug assembly 104 proceeds toward the receptacle 102. The receptacle 102 and assembly 104 first contact each other when the tip and/or tips 172 and 173, contact the beveled edge 234, 236 (shown in FIG. 7), respectively. With the mating force $F_m$ still applied, the beveled edge makes slidable contact with the respective tip, thereby guiding the plug assembly into the aligned position. The guide posts 156 and 157 continue through guide openings 230 and 232, respectively, until the tips 172 and 173 pass through the rear aperture 242 and 244, respectively. In the engaged position (shown in FIG. 10A), the face 202 (FIG. 7) of the plug assembly 104 is adjacent or abutting surface 177 (FIG. 4) of the mounting structure 124. In one embodiment, when the receptacle 102 and the plug assembly 104 are engaged, the protuberance 193 (shown in FIG. 2) slides into the corresponding notch 238.

Figure 10A:
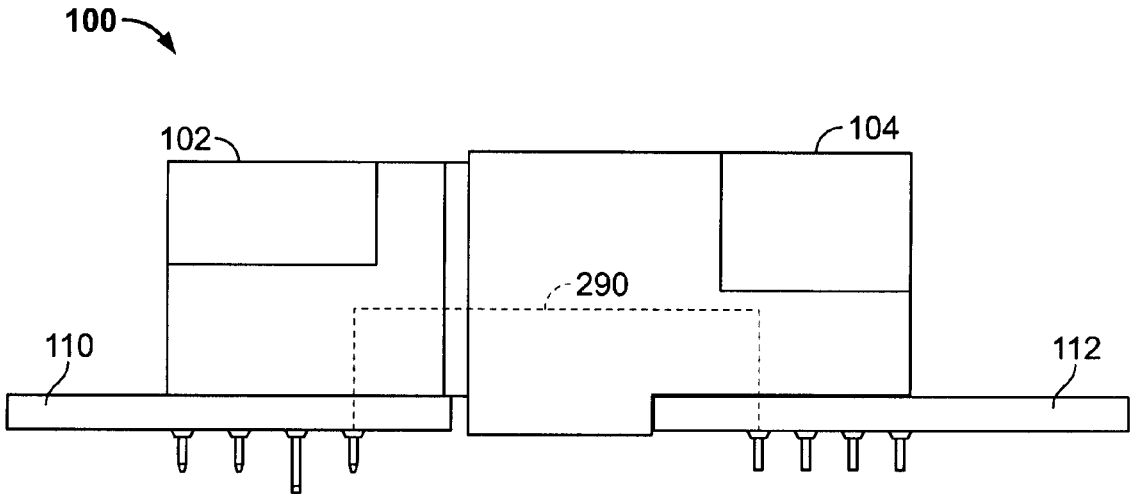
FIGS. 10A-10D show several configurations that a connector assembly formed in accordance with the exemplary embodiment may have.
Figure 10B:
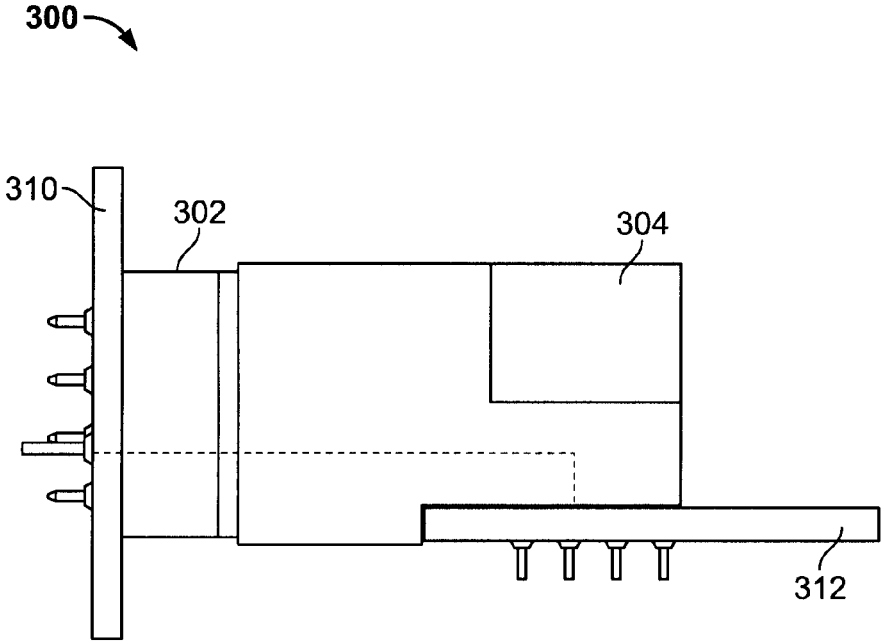

FIGS. 10A-10D illustrate four engaged board-to-board arrangements of a connector assembly formed in accordance with the exemplary embodiment. FIG. 10A shows a side view of the connector assembly 100 shown in FIG. 1. The plug assembly 104 and the receptacle 102 each have right-angle configurations. A "right-angle" configuration, as used herein, means that the corresponding connector face and the surface of the corresponding circuit board are perpendicular with respect to each other. FIG. 10B illustrates an electrical connector assembly 300 having a receptacle 302 mounted to a circuit board 310 and engaging a plug assembly 304, which is mounted to a circuit board 312. The receptacle 302 has a vertical configuration. A "vertical" configuration, as used herein, means that the corresponding connector face and the surface of the corresponding circuit board are parallel with respect to each other. When the receptacle has a vertical configuration the guide posts (not shown) extend in a direction substantially parallel to the fastener passage and the latch cavity (not shown).

Figure 10C:
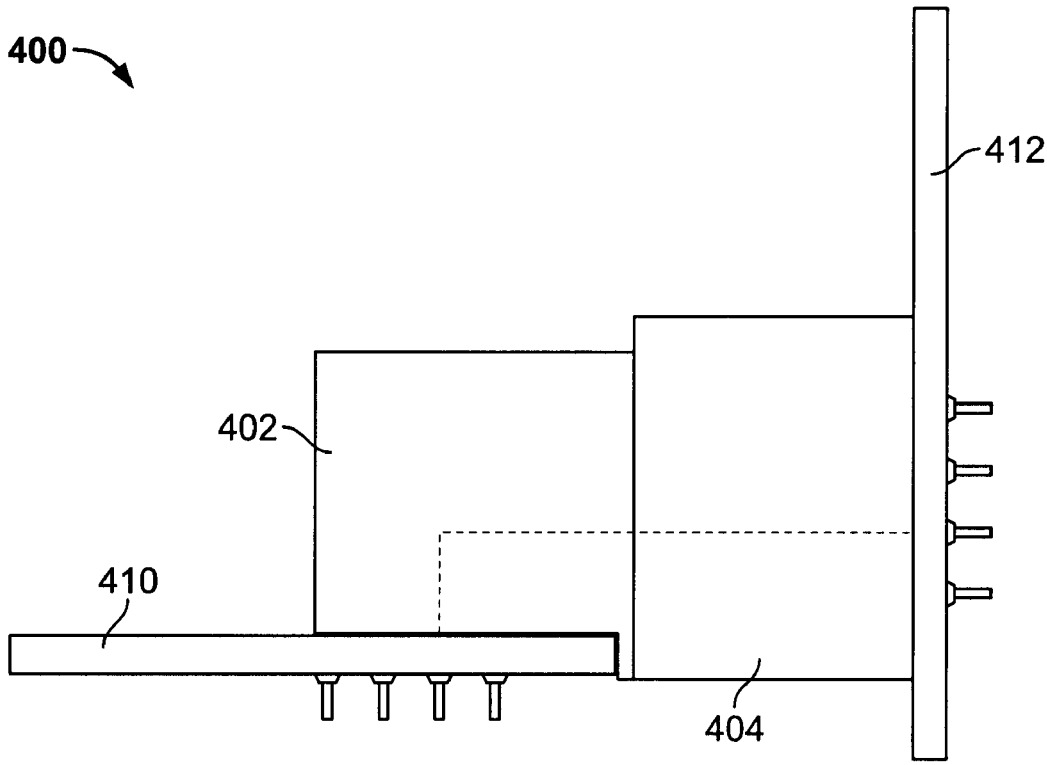
Figure 10D:
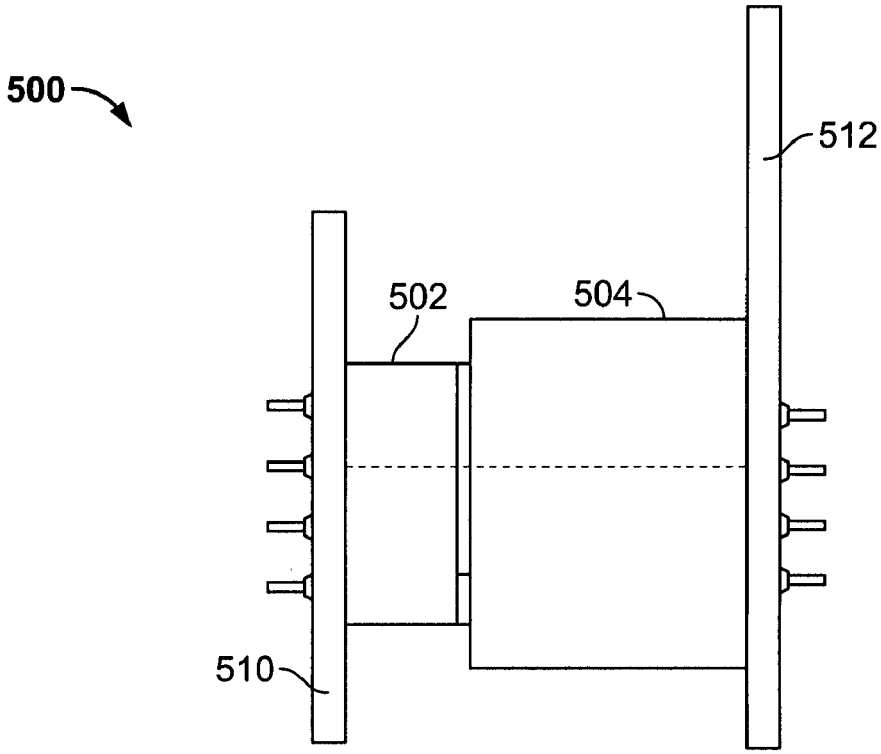

FIG. 10C illustrates an electrical connector assembly 400 having a right-angle receptacle 402 mounted onto a circuit board 410 and engaging a vertical plug assembly 404 that is mounted to a circuit board 412. FIG. 10D illustrates an electrical connector assembly 500 having a vertical receptacle 502 mounted onto a circuit board 510 and engaging a vertical plug assembly 504 that is mounted to a circuit board 512.

It is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle for an electrical connector assembly, the receptacle comprising:

a housing comprising opposite first and second housing sides and a contact retention portion for holding an electrical contact, the contact retention portion extending between the first and second housing sides and including a connector face for engaging a plug assembly; and first and second guide posts located adjacent to and extending along, respectively, the first and second housing sides, each of the first and second guide posts comprising a base and a tip and having a curved contour and a planar side that extend from the base to the tip, wherein the planar sides of the first and second guide posts substantially oppose each other across the connector face, wherein the curved contour of each guide post includes a portion that is substantially dome-shaped such that a diameter of the corresponding guide post measured along the planar side of the dome-shaped portion reduces in a non-linear manner as the corresponding guide post extends from the base to the tip, and wherein cross-sections of the first and second guide posts form substantially truncated circles.

2. The receptacle in accordance with claim 1 wherein each of the planar sides is positioned proximate to the corresponding housing side.

3. The receptacle in accordance with claim 1 wherein each of the first and second housing sides has a corresponding mounting structure extending outward from and along the corresponding housing side, the base of the corresponding guide post extending from the corresponding mounting structure.

4. The receptacle in accordance with claim 1 wherein each of the substantially dome-shaped curved contours of the first and second guide posts has a cross-section that is substantially half-circle in shape.

5. The receptacle in accordance with claim 1 wherein the housing further comprises a mounting face that extends perpendicular to the connector face, the mounting face configured to be mounted onto a circuit board such that the circuit board extends perpendicular to the connector face.

6. The receptacle in accordance with claim 1 wherein the housing further comprises a mounting face and at least one of a latch cavity and a fastener passage extending into the housing from the mounting face in a first direction, each of the first and second guide posts extending from the corresponding base to the corresponding tip in a second direction that is perpendicular to the first direction.

7. The receptacle in accordance with claim 1 wherein each of the first and second guide posts also includes a portion having a diameter that decreases in a linear manner as each of the first and second guide post extends longitudinally toward the corresponding tip.

8. The receptacle in accordance with claim 1 wherein the planar sides of the first and second guide posts directly oppose each other across the connector face such that the planar sides extend parallel to one another.

9. The receptacle in accordance with claim 1 wherein the tip includes a flat top having a surface that extends parallel to the connector face.

10. An electrical connector component comprising:

a housing comprising a contact retention portion for one of holding and receiving an electrical contact, the contact retention portion including a connector face for engaging a first electrical component and a housing side proximate to the connector face; and a mounting structure extending outward from and along the housing side, the mounting structure having a side surface that faces away from the housing side such that the housing side and the side surface face in a common direction, the mounting structure comprising a fastener passage and a latch cavity that extend into the mounting structure in substantially parallel directions, the fastener passage opening to the side surface such that fastener passage is exposed through the side surface, wherein the fastener passage is configured to receive a fastener for mounting to a surface of a second electrical component and the latch cavity is configured to receive a latch member for mounting to the surface of the second electrical component.

11. The electrical connector component in accordance with claim 10 wherein the housing holds a power contact and a signal contact.

12. The electrical connector component in accordance with claim 10 wherein the housing side is a first housing side and the mounting structure is a first mounting structure, the electrical connector component further comprising a second housing side and a second mounting structure extending outward from and along the second housing side, the second mounting structure having a second side surface that faces away from the second housing side, the second mounting structure including at least one of a second fastener passage and a second latch cavity extending into the second mounting structure, the second fastener passage also being exposed through the second side surface so that the housing has a reduced width measured between the first and second side surfaces.

13. The electrical connector component in accordance with claim 12 further comprising a maximum width, the maximum width being the reduced width that is measured between the first and second side surfaces.

14. The electrical connector component in accordance with claim 10 wherein the electrical connector component is one of a receptacle and a plug assembly.

15. The electrical connector component in accordance with claim 10 wherein the second electrical component is a circuit board.

16. The electrical connector component in accordance with claim 10 wherein the mounting structure extends laterally outward away from the housing side and extends longitudinally between a back of the contact retention portion and the connector face, the latch cavity and the fastener passage being longitudinally aligned with respect to each other along the housing side.

17. The electrical connector component in accordance with claim 10 further comprising a guide post that projects away from the mounting structure to engage the first electrical component.

18. The electrical connector component in accordance with claim 17 wherein the guide post has a planar side and wherein the planar side and the side surface extend along respective planes that are substantially co-planar with respect to each other.

19. The electrical connector component in accordance with claim 17 wherein the mounting structure extends laterally outward away from the housing side and extends longitudinally between a back of the contact retention portion and a plane of the connector face, wherein the latch cavity, the fastener passage, and the guide post are substantially longitudinally aligned with respect to each other along the housing side such that a longitudinal axis drawn perpendicular to the plane of the connector face extends through portions of the latch cavity, the fastener passage, and the guide post.

20. The electrical connector component in accordance with claim 17 wherein the guide post comprises a base and a tip and has a curved contour and a planar side that extend from the base to the tip, wherein the curved contour of the guide post includes a portion that is substantially dome-shaped such that a diameter of the guide post measured along the planar side of the dome-shaped portion reduces in a non-linear manner as the guide post extends from the base to the tip.

* * * * *